US007044850B2

(12) United States Patent
Koch et al.

(10) Patent No.: US 7,044,850 B2
(45) Date of Patent: May 16, 2006

(54) OPEN PATIENT CARE UNIT

(75) Inventors: Jochim Koch, Ratzeburg (DE); Artur Chung-Che Kuo, Lübeck (DE)

(73) Assignee: Dräger Medical AG & Co. KGaA, Lübeck (DE)

( * ) Notice: Subject to any disclaimer, the term of this patent is extended or adjusted under 35 U.S.C. 154(b) by 143 days.

(21) Appl. No.: 10/775,950

(22) Filed: Feb. 10, 2004

(65) Prior Publication Data

US 2004/0224626 A1 Nov. 11, 2004

(30) Foreign Application Priority Data

May 7, 2003 (DE) ..... 103 20 195

(51) Int. Cl.
*F24F 9/00* (2006.01)

(52) U.S. Cl. ..... 454/188; 454/189; 128/204.18

(58) Field of Classification Search ..... 454/188, 454/189; 128/204.18
See application file for complete search history.

(56) References Cited

U.S. PATENT DOCUMENTS 3,511,162 A * 5/1970 Truhan ..... 454/187
3,935,803 A * 2/1976 Bush ..... 454/189
3,954,429 A * 5/1976 van der Waaij ..... 96/136
4,742,764 A 5/1988 Duvlis
5,453,077 A 9/1995 Donnelly
5,759,149 A 6/1998 Goldberg et al.
5,971,914 A 10/1999 Donnelly
6,036,634 A * 3/2000 Goldberg et al. ..... 600/22
6,270,452 B1 * 8/2001 Donnelly et al. ..... 600/22
6,296,606 B1 * 10/2001 Goldberg et al. ..... 600/22
6,702,662 B1 * 3/2004 Kristensson ..... 454/187
6,755,036 B1 * 6/2004 Sastry ..... 62/176.5
6,869,458 B1 * 3/2005 Iijima et al. ..... 55/385.2
2002/0143233 A1 10/2002 Donnelly

FOREIGN PATENT DOCUMENTS

DE 34 30 089 A1 2/1986
DE 43 27 397 A1 2/1995

* cited by examiner

*Primary Examiner*—Derek S. Boles
(74) *Attorney, Agent, or Firm*—McGlew & Tuttle PC

(57) ABSTRACT

An open patient care unit with a bed (1), with inner and outer air discharge channels (20, 30) extending around the bed (1) at least over some sections, and with at least one air exhaust or a purgative suction unit (4) arranged above the bed (1), wherein the air discharge channels (20, 30) are directed such that they converge toward the air exhaust or purgative suction unit (4), and wherein ambient air delivered via a first fan (6) is discharged from the outer air discharge channels (30), and air, which is conditioned in terms of humidity and/or temperature and is delivered via a second fan (8) from the air exhaust or purgative suction unit (4), is discharged from the inner air discharge channels (20), has the essential advantage that a hood, which is used in incubators, is not used at all, so that switching over between different operating states is not necessary, and cooling down of the patient is thus avoided, but good access is at the same time ensured for the care providers.

18 Claims, 6 Drawing Sheets

OPEN PATIENT CARE UNIT

FIELD OF THE INVENTION

The present invention relates to an open patient care unit and pertains more particularly to a system, method and apparatus for having inner and outer air discharge channels extending parallel around the bed at least over some sections of the bed and at least one air exhaust or purgative suction unit arranged above the bed.

BACKGROUND OF THE INVENTION

A care units with good access to the patient by the care providers are used especially in the field of neonatology, as an alternative or as a complement to incubators which are generally closed with a hood.

A patient care unit with a hood that can be lowered and with an air flow over the bed is disclosed in U.S. Pat. No. 5,759,149, in which the point at which the air flow components meet and the site at which they are drawn off are generally separated in space and coincide only when the hood is closed. The switch-over between different operating states is associated with cooling of the patient in this prior-art care unit.

SUMMARY OF THE INVENTION

The primary object of the present invention is to provide an open patient care unit without a hood, while continuously ensuring a stable microclimate in terms of air humidity and air temperature for the patient, such that the microclimate is separated from the surrounding environment.

The object is accomplished with the features of an open care unit having a bed with inner and outer air discharge channels extending parallel around the bed at least over some sections, and at least one air exhaust or purgative suction unit arranged above the bed, wherein the air exhaust channels are directed such that they converge toward the air exhaust unit. The ambient air delivered to the bed by a first fan is discharged from the outer air discharge channels. The air which is conditioned in terms of humidity and/or temperature and is delivered by means of a second fan from the air exhaust unit is discharged from the inner air discharge channels.

An essential advantage of the present invention arises from the fact that unlike in incubators, no hood is used at all, so that switching over between different operating states is not necessary, and the patient is thus prevented from cooling down. On the other hand, the patient is continuously conditioned in terms of the air temperature and humidity over the bed and good access is at the same time ensured for the care providers.

Patient care units according to the present invention can be used not only for the open patient care for premature and newborn babies, but also for the heat therapy of patients in general, for the care of burn victims with loss of skin and associated loss of moisture as well as in the form of correspondingly designed operating tables for conditioning patients during a surgery.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
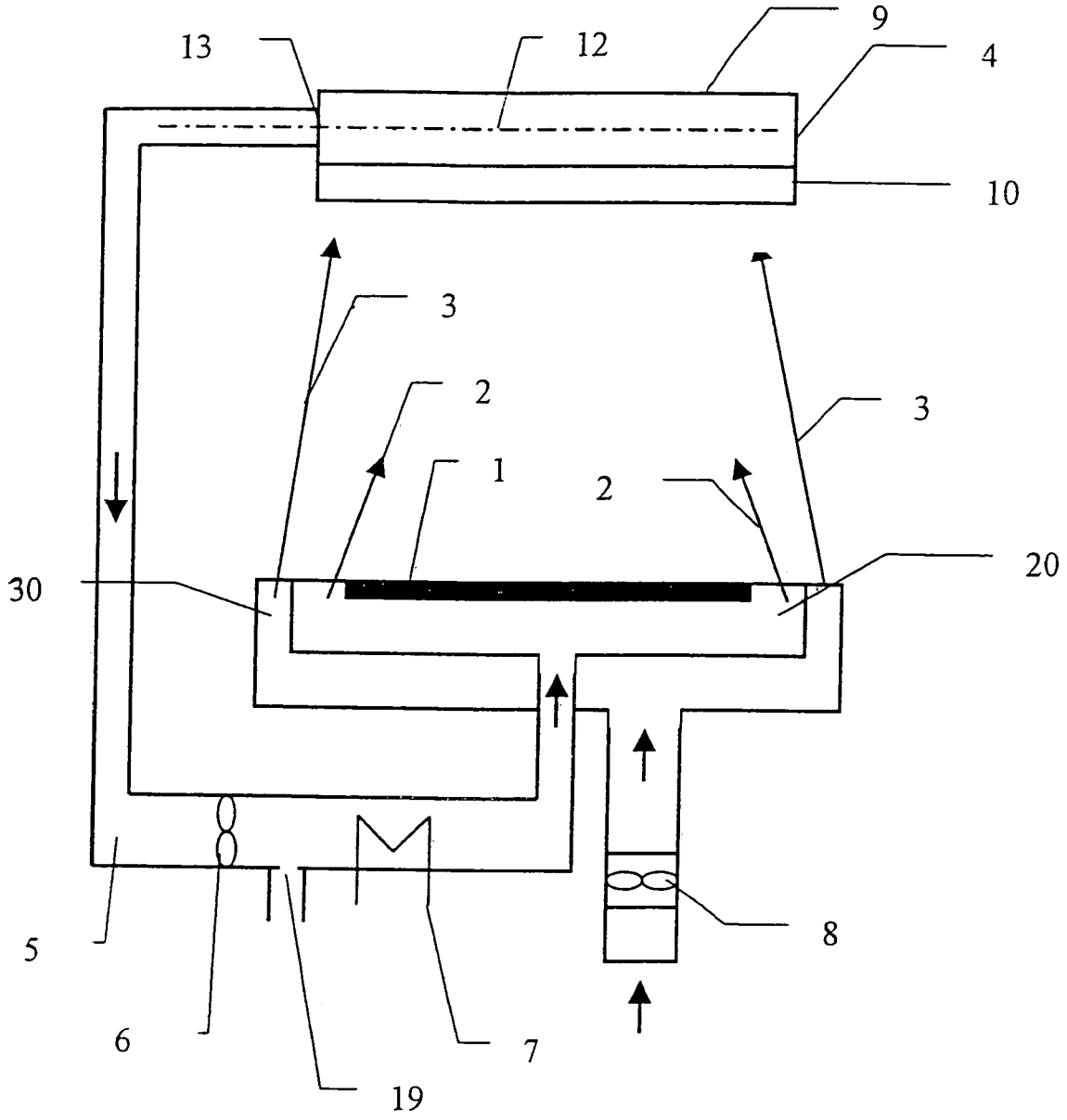
FIG. 1 is a vertical sectional view taken along the central longitudinal axis of an open patient care unit according to the invention.

Referring to the drawings in particular, the open patient care unit according to FIG. 1 has an elongated bed 1 for accommodating a patient. Air, which is warm and humid in relation to the ambient air, is blown out obliquely inwardly and in a convergent flow from inner air discharge channels 20 extending on each side over at least some sections on all four sides of the bed 1. This air has an inner air flow 2 and this air generates a microclimate that is favorable for the patient in the area on and above the bed 1. A second, outer, likewise converging air flow 3 is delivered in parallel or quasi in parallel to the inner air flow 2 from outer air discharge channels 30 extending at least over some sections on each side of the bed 1. This outer air flow 3 has, in general, a higher velocity than the inner air flow 2 and is relatively cooler and drier, corresponding to the temperature and the relative humidity of the ambient air. The combined air flows 2, 3 therefore comprise a plurality of layers. To improve the stability of the combined air flows 2, 3, these air flows may also be composed of more than two layers with different temperatures and velocities.

Figure 2:
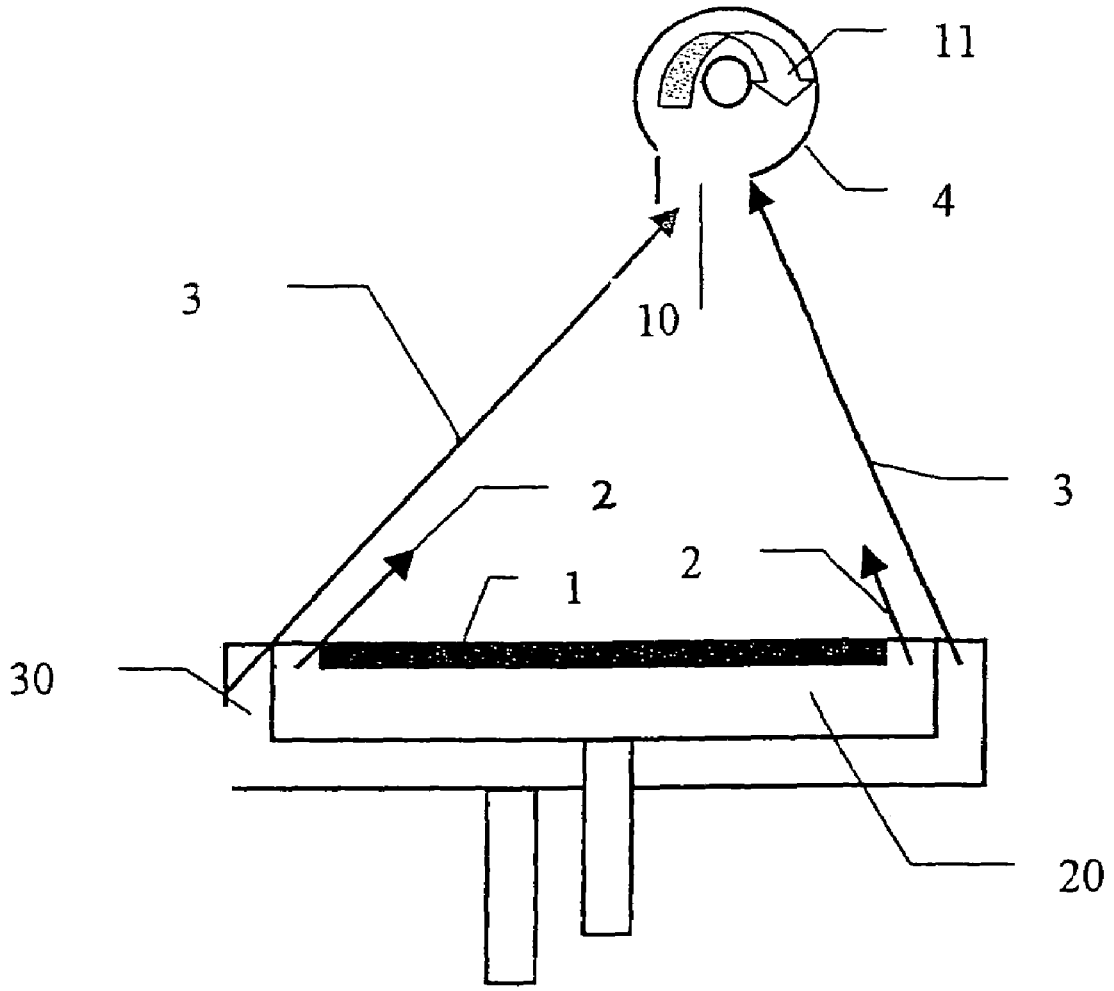
FIG. 2 is vertical sectional view taken at a right angle to the longitudinal direction of a bed of an open patient care unit according to the invention.

An air exhaust or purgative suction unit 4, which returns especially the warm air from the bed 1 via the inner air line 5 with the fan 6 and the heating and humidifying means 7 in a closed cycle by means of a swirling flow exhaust, is arranged above the bed 1. The reheated and humidified inner air flow 2 is finally discharged again from the inner air discharge channels 20, and the outer air flow 3 is delivered by means of a second fan 8 into the outer air discharge channels 30. The opening 19 is optionally used to release excess air from the inner air circulation into the environment. The air exhaust unit 4 may have different variations. In the simplest case it is a slotted tube 9 (see also FIG. 2), which extends in the longitudinal direction above the bed 1. The tube 9 is arranged according to this embodiment such that the air is drawn in tangentially via a slot 10 extending along the tube 9. An axial air swirl 11 is formed in the interior of the air exhaust or purgative suction unit 4, and this air swirl rotates with increasing speed in the direction of the central axis 12 and generates a spiral tubular flow, while the air mass concentrates on the center line of the tube. An exhaust guide 13, which leads to the fan 6 bringing about the exhaust, is provided centrally at the end of the tube 9.

The air exhaust or purgative suction unit 4 may also be located eccentrically offset over the bed 1 in order not to hinder the X-raying of the patient on the bed 1. This special arrangement is also suitable for additionally heating the patient with a heat radiator or to irradiate him with a phototherapy unit.

If a plurality of air exhaust or purgative suction units 4 are used, these may be arranged, in general, in parallel to the longitudinal direction of the bed 1. As an alternative or in addition, exhaust or purgative suction units 4 may be arranged each above one or both shorter sides of the bed 1, so that four such means are present at most above the bed 1. Each of these possible arrangements are discussed in more detail below.

Figure 3:
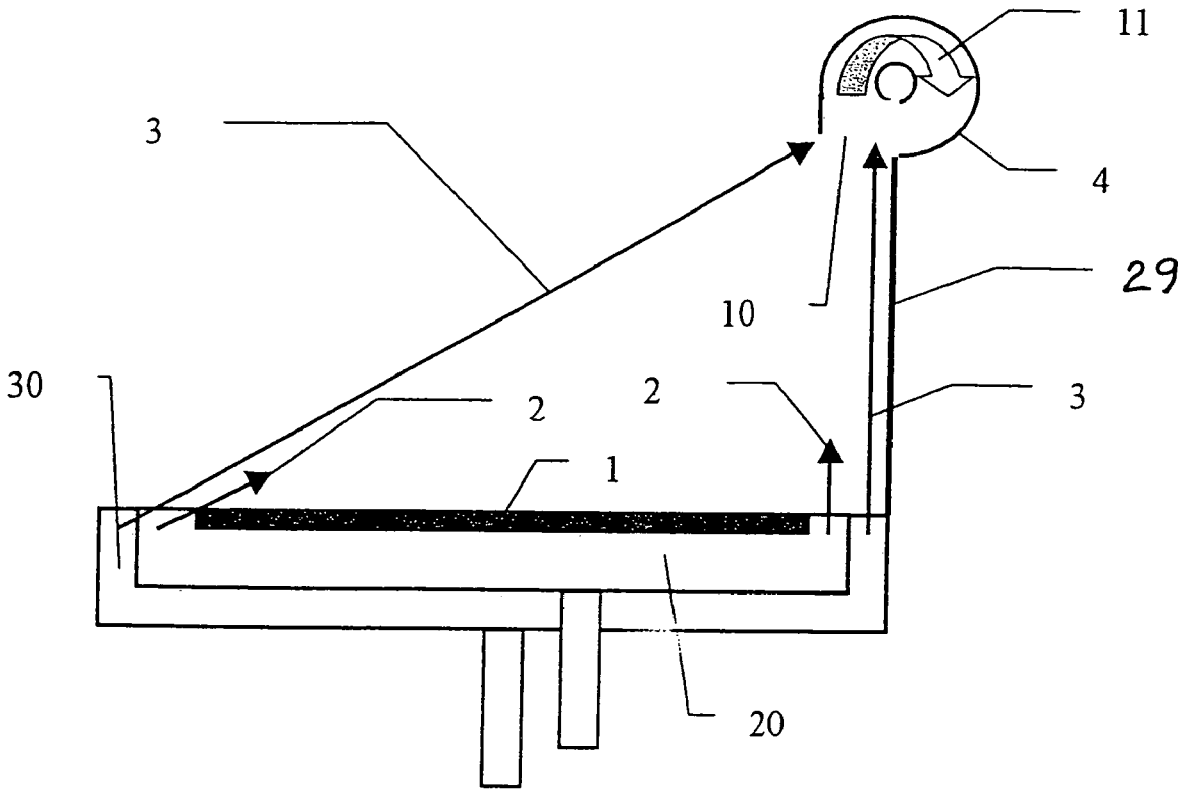
FIG. 3 is a vertical sectional view corresponding to FIG. 1 with an air exhaust or purgative suction unit 4 arranged eccentrically in relation to the bed 1.

FIG. 3 shows another variant of the open patient care unit with an exhaust or purgative suction unit 4 arranged eccentrically offset above the bed 1. The exhaust or purgative suction unit 4 extends according to FIG. 3 above a long side and in parallel to the longitudinal axis of the bed 1, but it may also extend, as an alternative, above and in parallel to one of the shorter sides of the bed 1. The air flow can be stabilized by a vertical wall 29, so that the air flows 2, 3 may be optionally done away with on the wall side at least in some sections.

The velocities of flow of the air flows 2, 3 are in the range of 10 cm to 80 cm per sec, and the ratio of the velocity of the inner air flow 2 to that of the outer air flow 3 ranges from about 2:1 to 3:1. The inner air flow brings about the maintenance of the microclimate above the bed 1 with warm and humid air with temperatures of up to 39° C. and relative humidities of up to 85%. The outer air flow 3 consists of relatively cool and dry air corresponding to the ambient air.

Present invention also provides an opportunity for an improved air turbulence and improved energy efficiency. For instance, if the outer discharge channels supply gas which do not correspond to the ambient air, but rather an air that has lower air temperature and reduced air velocity than the inner discharge channel, but still higher temperature and higher air velocity than the ambient air, this minimizes possibility of turbulence on the patient's bed and also minimizes energy losses as well.

Figure 4:
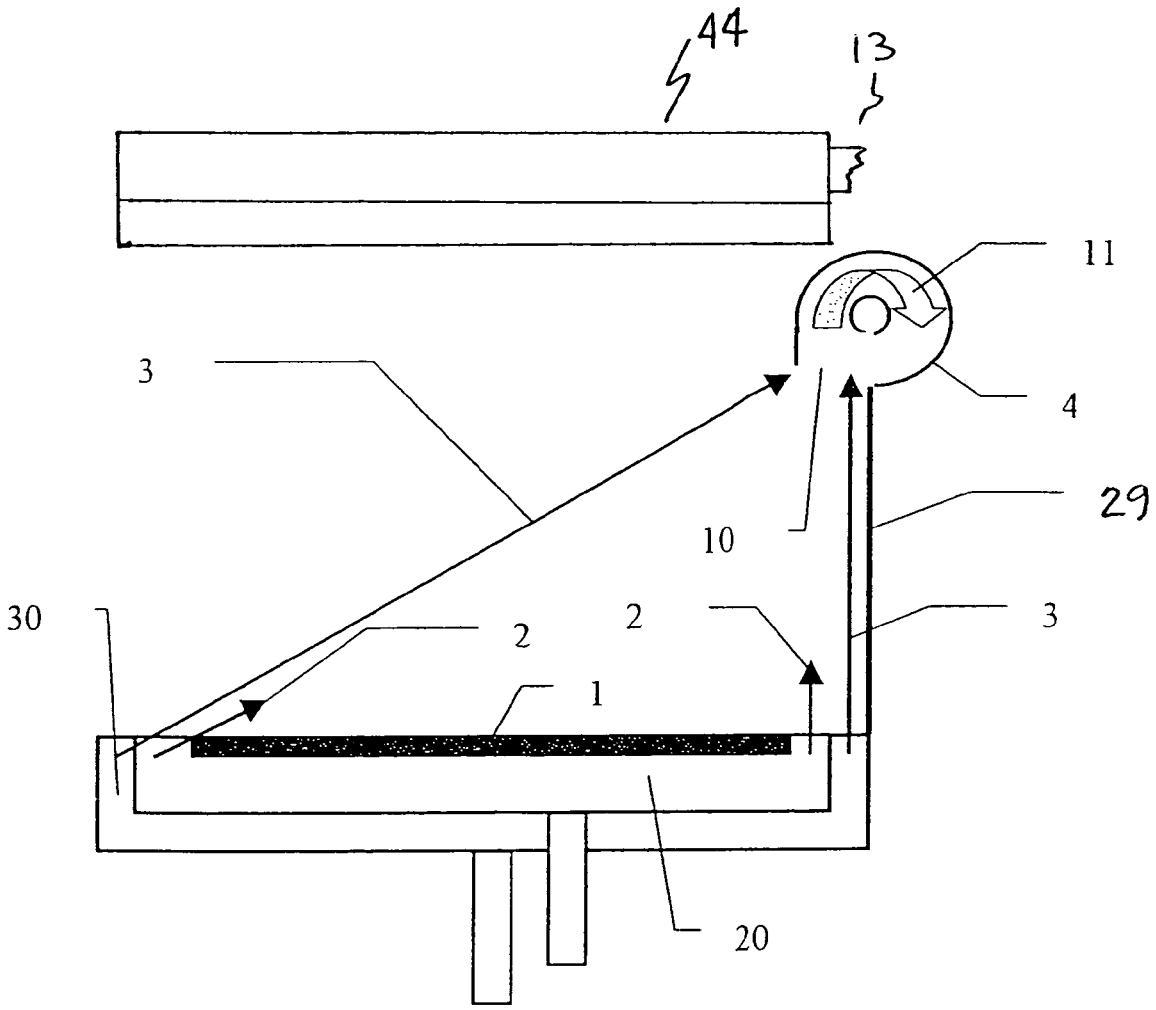
FIG. 4 is a vertical sectional view corresponding to FIG. 1 with an air exhaust or purgative suction unit 4 arranged eccentrically offset above the bed 1 and another exhaust or purgative suction unit 44 arranged eccentrically offset above a longitudinal direction of the bed 1.

FIG. 4 shows another variant of the open patient care unit with an exhaust or purgative suction unit 4 arranged eccentrically offset above the bed 1 and another exhaust or purgative suction unit 44 arranged eccentrically offset above the bed 1. The exhaust or purgative suction unit 44 extends laterally, above a longitudinal side (i.e., a side extending in the longitudinal direction or long direction) of the bed 1. The exhaust or purgative suction unit 4 is arranged extending above a lateral side (i.e., a side extending in the lateral direction or short direction) above the bed 1. Instead of a single exhaust unit 4, plural exhaust units 4, 44 can be provided in various positions including one or more exhaust unit eccentrically offset above the bed 1. In the embodiment of FIG. 4, the air flow can be stabilized by a vertical wall 29, so that the air flows 2, 3 may be optionally done away with on the wall side at least in some sections.

Figure 5:
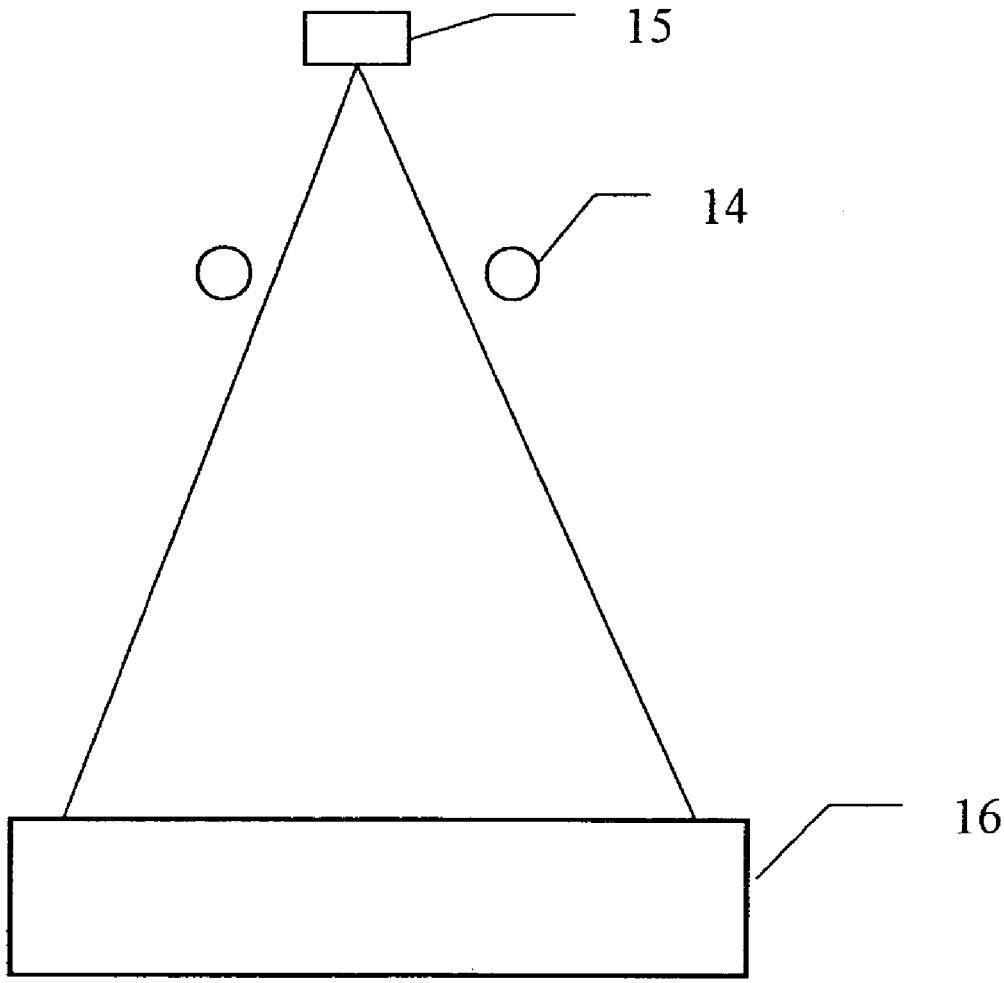
FIG. 5. is a vertical sectional view taken at a right angle to the longitudinal direction of a bed with two air exhaust or purgative suction units 14 positioned parallel to another longitudinal device (such as a radiant warmer or an X-ray unit) above the bed.

FIG. 5 shows another possible position for the exhaust or purgative suction unit. FIG. 5 shows a cross sectional view of two air exhaust or purgative suction units 14. These are positioned parallel to another longitudinal device (such as a radiant warmer or an X-ray unit) above the bed, but out of the way of the other longitudinal device. The parallel arrangement of exhaust units and another longitudinal device may be positioned alongside the longitudinal side or the latitudinal side of the bed. Functionally, a radiant warmer or an X-Ray unit 15 could irradiate the patient lying on the bed, and the exhaust units would not hinder such function since the exhaust units are clear of the intervening space between the longitudinal device and the bed.

Figure 6:
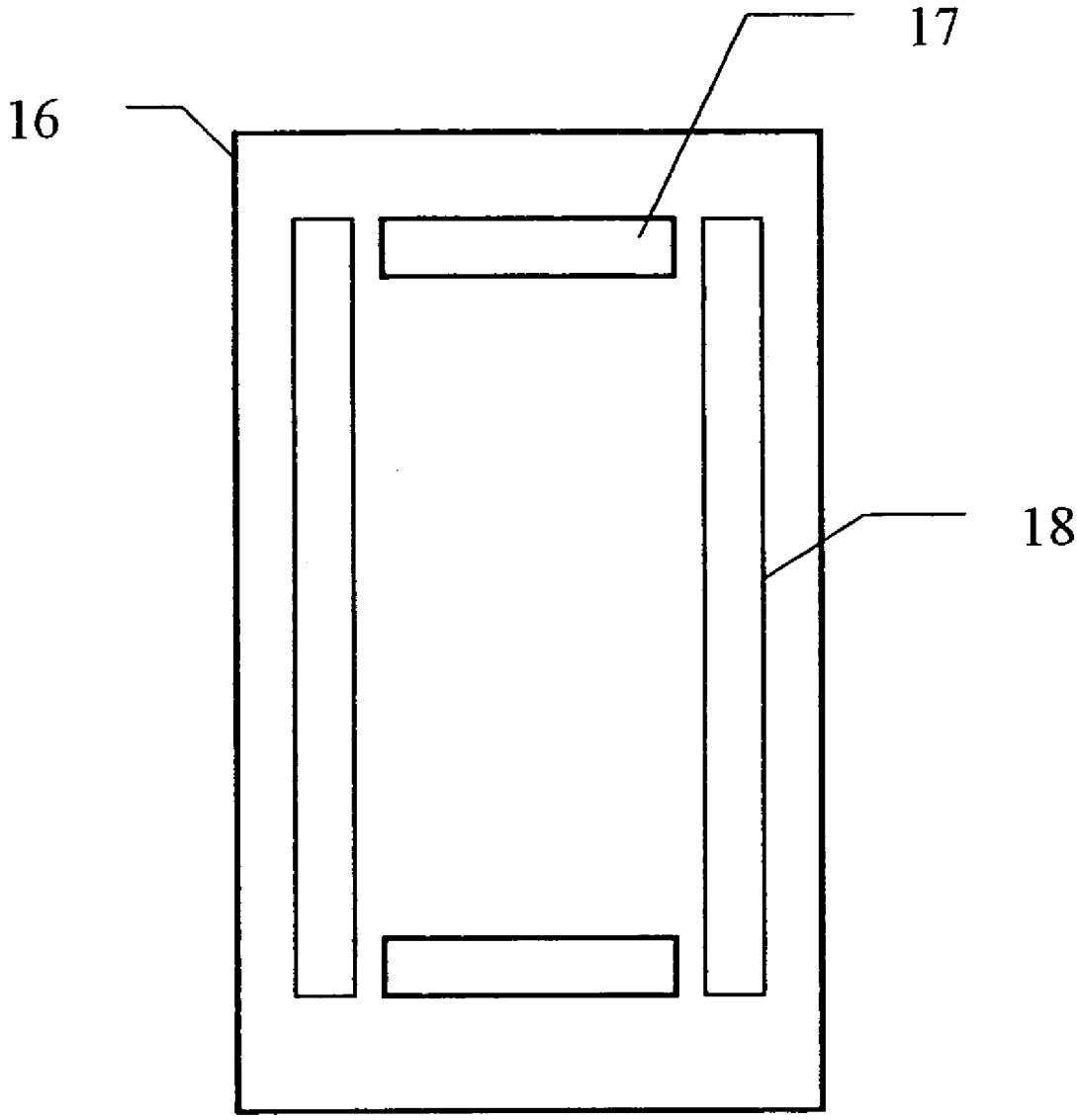
FIG. 6 is a top view of a bed with four air exhaust or purgative suction units positioned parallel to all sides of the bed.

Another further embodiment of the present invention is shown in FIG. 6, where four exhaust or purgative suction devices (17 and 18) are placed above the bed 16. FIG. 6 shows a top view of a bed with two air exhaust or purgative suction units 17 positioned parallel to two shorter sides of the bed. Two additional air exhaust or purgative suction units 18 are positioned parallel to the two longer sides of the bed.

While specific embodiments of the invention have been shown and described in detail to illustrate the application of the principles of the invention, it will be understood that the invention may be embodied otherwise without departing from such principles.

What is claimed is:

1. An open patient care unit, comprising:

a bed;

an inner air discharge channel positioned parallel to said bed;

an outer air discharge channel extending in parallel to said inner discharge channel at least over some sections of said inner air discharge channel;

an air purgative suction unit arranged above said bed, said inner air discharge channel and said outer air discharge channel being directed toward said air purgative suction unit;

a first fan for delivering ambient air for discharge from said outer air discharge channel; and a second fan for delivering air, which is conditioned in terms of humidity and/or temperature, for discharge from said inner air discharge channel.

2. An open patient care unit in accordance with claim 1, wherein the velocity of the air being discharged from said inner air discharge channel and said outer discharge channel is 10 cm to 80 cm per second, and a ratio of a velocity of air being discharged from said outer air discharge channels to a velocity of said air flow being discharged from said inner discharge channel ranges from about 1:2 to 1:3.

3. An open patient care unit in accordance with claim 1, wherein a temperature and a relative humidity of the air leaving said outer air discharge channel corresponds to a temperature and a relative humidity of the ambient air, and relative humidity of air leaving said inner air discharge channel is 35% to 85%, and a corresponding temperature of air leaving said inner air discharge channel is 28° C. to 39° C.

4. An open patient care unit in accordance with claim 1, wherein temperature of air being discharged from said outer air discharge channel is cooler than temperature of ambient air and warmer than said inner discharge channel.

5. An open patient care unit in accordance with claim 1, wherein air flow velocity discharged from said outer air discharge is greater than air flow velocity of said inner discharge channel.

6. An open patient care unit in accordance with claim 1, further comprising another air purgative suction unit, said bed having longitudinal sides and lateral sides wherein air purgative suction unit extends in a longitudinal direction substantially in parallel to said longitudinal sides and said another air purgative suction unit is arranged above one of said lateral sides of said bed.

7. An open patient care unit in accordance with claim 1, further comprising a vertical wall, said bed having longer sides and shorter sides wherein said air purgative suction unit is arranged above and in parallel to one of said shorter sides of said bed and said vertical wall limits said outer air discharge channel from the environment in an area above said one of said shorter sides, over a section of said one of said shorter sides.

8. An open patient care unit comprising:

a bed;

an inner air discharge channel positioned parallel over some sections of said bed;

an outer air discharge channel, wherein said air discharge channels extend adjacent to said inner air discharge over a section of said bed;

an air purgative suction unit arranged above said bed;

a first fan delivering gas for discharge as a first gas flow from said outer air discharge channel; and a second gas fan delivering gas for discharge as a second gas flow from said inner air discharge channel, said inner air discharge channel and said outer air discharge channel being directed such that said first gas flow and said second gas flow converge toward said air purgative suction unit; and a gas conditioning means for conditioning the gas for said second gas flow in terms of at least one of humidity and temperature.

9. An open patient care unit in accordance with claim 8, wherein said gas conditioning means includes a heater for controlling a temperature of said second gas flow.

10. An open patient care unit in accordance with claim 8, wherein said gas conditioning means includes a humidifier for controlling a humidity of said second gas flow.

11. An open patient care unit in accordance with claim 8, wherein said first gas flow discharged from said outer air discharge channel and said second gas flow discharged from said second inner air discharge channel have an air discharge velocity of 10 cm to 80 cm per second and a velocity ratio of said first gas flow discharged from said outer air discharge channel to said second gas flow discharged from said inner discharge channel range from 1:2 to 1:3.

12. An open patient care unit in accordance with claim 8, wherein said gas conditioning means includes a heating means and a humidifying means and controls a temperature and a humidity of a space above said bed to attain a preset temperature and a preset humidity by humidifying and heating said second gas flow and regulating the humidifying and heating as function of temperature and humidity of ambient air.

13. An open patient care unit in accordance with claim 8, wherein said gas conditioning means includes a heating means and a humidifying means and said second gas flow is humidity controlled by said humidifying means and is temperature controlled by said heating means and a temperature and a relative humidity of said first gas flow leaving said outer air discharge channels correspond to a temperature and a relative humidity of ambient air, and a relative humidity of said second gas flow leaving said inner air discharge channels is 35% to 85%, and a corresponding temperature of said second gas flow is 28° C. to 39° C.

14. An open patient care unit in accordance with claim 8, wherein said bed has longitudinal sides extending in a longitudinal direction and has lateral sides extending in a lateral direction and wherein said air purgative suction unit extends in said longitudinal direction of said bed.

15. An open patient care unit in accordance with claim 14, wherein said air purgative suction unit is arranged above and in parallel to said longitudinal sides of said bed.

16. An open patient care unit in accordance with claim 8, wherein said bed has longitudinal sides extending in a longitudinal direction and has lateral sides extending in lateral direction and wherein said air purgative suction unit extends in said lateral direction of said bed.

17. An open patient care unit in accordance with claim 8, further comprising;

another purgative suction unit, wherein said bed has longitudinal sides extending in a longitudinal direction and has lateral sides extending in a lateral direction and wherein said air purgative suction unit extends in the longitudinal direction of said bed and said another air purgative suction unit is arranged extending in the lateral direction of said bed.

18. An open patient care unit in accordance with claim 14, further comprising a wall, said bed having longer sides and shorter sides wherein said air purgative suction unit is arranged above and in parallel to one of said shorter sides of said bed and said wall limits said outer air discharge channel from the environment in an area above said one of said shorter sides, over a section of said one of said shorter sides.

* * * * *